US009945001B2

(12) United States Patent
Fujiwara et al.

(10) Patent No.: US 9,945,001 B2
(45) **Date of Patent: *Apr. 17, 2018**

(54) BLAST FURNACE OPERATION METHOD AND LANCE

(71) Applicant: JFE STEEL CORPORATION, Chiyoda-ku, Tokyo (JP)

(72) Inventors: Daiki Fujiwara, Tokyo (JP); Akinori Murao, Tokyo (JP); Takeshi Kajisa, Tokyo (JP); Mitsushi Tokudome, Tokyo (JP)

(73) Assignee: JFE STEEL CORPORATION, Tokyo (JP)

( * ) Notice: Subject to any disclaimer, the term of this patent is extended or adjusted under 35 U.S.C. 154(b) by 54 days.

This patent is subject to a terminal disclaimer.

(21) Appl. No.: 14/781,698

(22) PCT Filed: Mar. 27, 2014

(86) PCT No.: PCT/JP2014/058797

§ 371 (c)(1),
(2) Date: Oct. 1, 2015

(87) PCT Pub. No.: WO2014/162965

PCT Pub. Date: Oct. 9, 2014

(65) Prior Publication Data

US 2016/0040261 A1 Feb. 11, 2016

(30) Foreign Application Priority Data

Apr. 3, 2013 (JP) ..... 2013-077523

(51) Int. Cl.
*C21B 7/16* (2006.01)
*F27B 1/16* (2006.01)
(Continued)

(52) U.S. Cl.
CPC ..... *C21B 7/163* (2013.01); *C21B 5/001* (2013.01); *C21B 5/02* (2013.01); *F27B 1/16* (2013.01)

(58) Field of Classification Search
CPC ..... C21B 5/001; C21B 5/003; C21B 7/163; C21B 5/02; F27B 1/16; F27B 2003/169; F27B 3/16; F27B 2001/04
(Continued)

(56) References Cited

U.S. PATENT DOCUMENTS 4,243,211 A * 1/1981 Leroy ..... C21C 5/48 266/268
9,309,578 B2 * 4/2016 Murao ..... C21B 7/163
(Continued)

FOREIGN PATENT DOCUMENTS

CN 200942372 9/2007
CN 200942372 Y 9/2007
(Continued)

OTHER PUBLICATIONS

Supplementary European Search Report for Application No. EP 14780034, dated Mar. 2, 2016.
(Continued)

*Primary Examiner* — Scott Kastler
*Assistant Examiner* — Michael Aboagye
(74) *Attorney, Agent, or Firm* — RatnerPrestia

(57) ABSTRACT

A method is provided for operating a blast furnace by blowing a solid reducing material, a flammable gaseous reducing material and a combustible gas into a blast furnace from tuyeres through a lance into a blast furnace, wherein a parallel type lance prepared by bundling three independent blowing tubes in parallel and integrally housing them into an outer tube is used, and either one or both of the gaseous reducing material and the combustible gas and the solid
(Continued)

reducing material are simultaneously blown through the respective blowing tubes, while the blowing tube for the solid reducing material and the blowing tube for the gaseous reducing material are positioned above the blowing tube for the combustible gas in the blowing through the parallel type lance as well as a lance structure thereof.

6 Claims, 11 Drawing Sheets

(51) Int. Cl.
*C21B 5/00* (2006.01)
*C21B 5/02* (2006.01)

(58) Field of Classification Search
USPC ..... 266/47, 268; 75/530, 532, 539
See application file for complete search history.

(56) References Cited

U.S. PATENT DOCUMENTS

| | | | |
|---|---|---|---|
| 9,410,218 | B2 | 8/2016 | Murao et al. |
| 2011/0101576 | A1 | 5/2011 | Cho et al. |
| 2015/0184263 | A1 | 7/2015 | Murao |
| 2016/0040261 | A1 | 2/2016 | Fujiwara et al. |

FOREIGN PATENT DOCUMENTS

| | | | | | |
|---|---|---|---|---|---|
| EP | 2653565 | | * | 10/2013 | ..... C21B 7/163 |
| EP | 2653565 | A1 | | 10/2013 | |
| FR | 2681417 | A1 | | 3/1993 | |
| JP | H01-92304 | A | | 4/1989 | |
| JP | H03038344 | U | | 4/1991 | |
| JP | H05125412 | A | | 5/1993 | |
| JP | 1112613 | | | 1/1999 | |
| JP | 2001200308 | | | 7/2001 | |
| JP | 2003096510 | A | | 4/2003 | |
| JP | 2003286511 | | | 10/2003 | |
| JP | 2003286511 | A | | 10/2003 | |
| JP | 2004183104 | | | 7/2004 | |
| JP | 2007162038 | | | 6/2007 | |
| JP | 4074467 | B2 | | 4/2008 | |
| JP | 2010537153 | | | 12/2010 | |
| JP | 2011174171 | A | | 9/2011 | |
| JP | 2012188743 | | | 10/2012 | |
| RU | 2245373 | C1 | | 1/2005 | |
| SU | 994561 | A2 | | 2/1983 | |
| WO | 0028097 | A1 | | 5/2000 | |
| WO | 2012098714 | | | 7/2012 | |
| WO | 2012098714 | A1 | | 7/2012 | |
| WO | WO 2012098714 | | * | 7/2012 | ..... C21B 7/163 |
| WO | 2014010660 | | | 1/2014 | |

OTHER PUBLICATIONS

Chinese Office Action dated July 28, 2016 for Chinese Application No. 201480019172.1, with English Search Report, 9 pages.
Russian Office Action for Russian Application No. 2015147170, dated Feb. 22, 2017, including English translation, 9 pages.
International Search Report for International Application No. PCT/JP2014/058797 dated Apr. 28, 2014.
Korean Office Action for Application No. 2015-7027225, dated Jul. 1, 2016 with Concise Statement of Relevance of Office Action, 6 pages.
Final Office Action for U.S. Appl. No. 14/781,693, dated Sep. 21, 2017, 28 pages.
Non Final Office Action for U.S. Appl. No. 14/781,698, dated Jun. 7, 2017, 10 pages.
Non Final Office Action for U.S. Appl. No. 14/412,340, dated Sep. 15, 2015, 9 pages.

* cited by examiner (a)

| | Nominal diameter | Nominal thickness | Outer diameter (mm) | Inner diamter (mm) | Thickness (mm) |
|---|---|---|---|---|---|
| Outer tube | 20A | Schedule 10S | 27. 20 | 23. 00 | 2. 1 |
| Middle tube | 15A | Schedule 40 | 21. 70 | 16. 10 | 2. 8 |
| Inner tube | 8A | Schedule 10S | 13. 80 | 10. 50 | 1. 65 |

(b)

| | Nominal diameter | Nominal thickness | Outer diameter (mm) | Inner diamter (mm) | Thickness (mm) |
|---|---|---|---|---|---|
| First tube | 8A | Schedule 5S | 13. 80 | 10. 50 | 1. 65 |
| Second tube | 6A | Schedule 10S | 10. 50 | 8. 10 | 1. 20 |
| Third tube | 6A | Schedule 20S | 10. 50 | 7. 50 | 1. 50 |

BLAST FURNACE OPERATION METHOD AND LANCE

CROSS-REFERENCE TO RELATED APPLICATIONS

This is the U.S. National Phase application of PCT International Application No. PCT/JP2014/058797, filed Mar. 27, 2014, and claims priority to Japanese Patent Application No. 2013-077523, filed Apr. 3, 2013, the disclosures of each of these applications being incorporated herein by reference in their entireties for all purposes.

FIELD OF THE INVENTION

This invention relates to a blast furnace operation method effective for the improvement of productivity and the reduction of specific consumption of a reducing material by blowing a flammable gaseous reducing material such as LNG (liquefied natural gas) or a combustible gas together with a solid reducing material such as pulverized coal or the like into the furnace through tuyeres to raise combustion temperature at tips of the tuyeres as well as a lance used in the operation of this method.

BACKGROUND OF THE INVENTION

Recently, global warming comes into problem with the increase of carbon dioxide emissions, and the suppression of $CO_2$ discharged becomes an important issue in the iron industry. As to such an issue, the operation with a low reduction agent ratio (abbreviated as low RAR, total amount of a reducing material blown through tuyeres and coke charged from a top of the furnace per 1 ton of pig iron) is driven forward in the recent blast furnace operations. Since coke and pulverized coal are mainly used as a reducing material in the blast furnace, in order to attain the low reduction agent ratio and hence the suppression of carbon dioxide emissions, it is effective to replace coke or the like with a reducing material having a high hydrogen content ratio such as waste plastic, LNG, heavy oil or the like.

Patent Document 1 discloses a technique wherein a solid reducing material, a gaseous reducing material and a combustible gas are simultaneously blown with a plurality of lances to promote the heating of the solid reducing material in a combustion field of the gaseous reducing material. In this technique, it is said that the combustion rate of the solid reducing material can be improved to suppress the generation of unburned powder or coke breeze to thereby improve the air permeability and decrease the reduction agent ratio. Patent Document 2 discloses a technique wherein a lance is multiple-tube type and, for example, a solid reducing material is blown through an inner tube and a combustible gas is blown from a gap between inner tube and middle tube and a gaseous reducing material is blown from a gap between middle tube and outer tube. Further, Patent Document 3 discloses that a plurality of small-size tubes are arranged around a main tube of the lance in parallel.

PATENT DOCUMENTS

Patent Document 1: JP-A-2007-162038
Patent Document 2: JP-A-2003-286511
Patent Document 3: JP-A-H11-12613

SUMMARY OF THE INVENTION

The blast furnace operation method disclosed in Patent Document 1 has an effect of raising the combustion temperature at the tip of the tuyere and reducing the specific consumption of the reducing material as compared to the method of blowing only the pulverized coal through the tuyere, but the effect is insufficient in only the adjustment of blowing positions. In the multiple-tube type lance disclosed in Patent Document 2, it is necessary to increase an outer blowing rate for ensuring the cooling ability of the lance. To this end, the gap between inner tube and outer tube should be made extremely narrow, which cannot flow the predetermined gas amount in view of the restriction of equipment and has a fear of obtaining no effect of improving the combustibility. If it is intended to establish the gas amount and the flow rate, the diameter of the lance becomes extremely large to bring about the decrease of blast volume in a blowpipe (blast tube), and hence an amount of molten iron tapped is decreased or the risk of breaking the surrounding refractories is increased associated with the increase of the diameter in the insert port of the lance. In the lance disclosed in Patent Document 3 are arranged a plurality of small-size blowing tubes, so that there are problems that not only a risk of clogging the blowing tube is enhanced due to the decrease of the cooling ability but also the process cost of the lance is increased. Furthermore, the multiple-tube structure is changed into a parallel-tube structure on the way thereof, so that there is a problem that the pressure loss and the diameter become large.

It is an object of the invention to propose a blast furnace operation method capable of overcoming the aforementioned problems inherent to the conventional techniques as well as a lance used in the operation of this method.

Especially, it is to propose a blast furnace operation method capable of attaining the enhancement of cooling ability and the improvement of combustibility and the reduction of specific consumption of a reducing material without making the diameter of the lance extremely large.

The invention is developed for solving the above tasks and includes a method of operating a blast furnace by blowing a solid reducing material, a gaseous reducing material and a combustible gas into a blast furnace from tuyeres through a lance, wherein a parallel type lance prepared by bundling three independent blowing tubes in parallel and integrally housing them into an outer tube for the lance is used, and either one or both of the gaseous reducing material and the combustible gas and the solid reducing material are simultaneously blown through the respective blowing tubes, while the blowing tube for the solid reducing material and the blowing tube for the gaseous reducing material are positioned above the blowing tube for the combustible gas in the blowing through the parallel type lance.

Also, the invention in one aspect includes a lance for blowing a solid reducing material, a gaseous reducing material and a combustible gas through tuyeres into a blast furnace, having a structure that three independent blowing tubes are bundled in parallel and integrally housed in an outer tube for lance when either one or both of the gaseous reducing material and the combustible gas are simultaneously blown together with the solid reducing material, and disposing the respective blowing tubes so as to satisfy a position relation that the blowing tube for the solid reducing material and the blowing tube for the gaseous reducing material are positioned above the blowing tube for the combustible gas.

In the invention are provided the following features as a preferable means:

(1) the blowing tube for solid reducing material, the blowing tube for gaseous reducing material and the blowing tube for combustible gas in the parallel type lance are arranged so that an angle of a face passing an outer contact point between a center of the blowing tube for solid reducing material and the outer tube for lance to a radially vertical face of the lance inserted into a blowpipe is within ±90°; and (2) each of the blowing tubes is a tube having an inner diameter of not less than 6 mm but not more than 30 mm.

According to the invention, the parallel type lance prepared by bundling the respective blowing pathways in parallel and integrally housing into the outer tube for lance can be used when the solid reducing material, flammable gaseous reducing material and combustible gas are simultaneously blown into the blast furnace, whereby the pathway of the blowing tube can be made large without increasing the outer diameter of the lance. According to the invention, therefore, it can be attempted to establish the increase of the cooling ability and the improvement of the combustibility, and hence the decrease of the specific consumption of the reducing material can be attained in the operation of the blast furnace.

DETAILED DESCRIPTION OF EMBODIMENTS OF THE INVENTION

Figure 1:
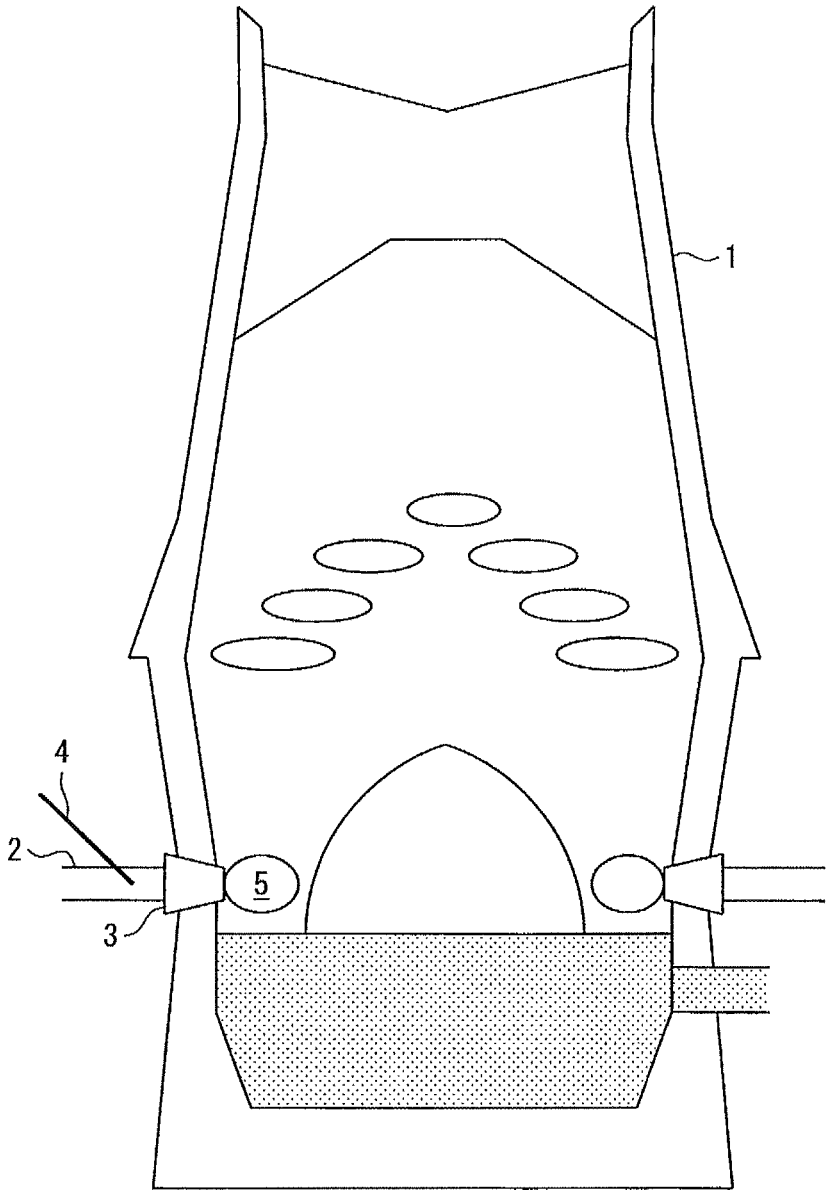
FIG. 1 is a longitudinal section view illustrating an example of the blast furnace.

The blast furnace operation method according to embodiments of the invention and the lance used in this operation will be described with reference to the accompanying drawings below. FIG. 1 is a schematic view of a blast furnace applied to the blast furnace operation method according to an embodiment of the invention. As shown in this figure, the blast furnace 1 is provided with plural tuyeres in its peripheral direction. To the tuyere 3 is connected a blowpipe (blast pipe) 2 for blowing hot air, and the blowpipe 2 is provided with a lance 4 inserted obliquely mainly from above toward a center of an axial direction of the blowpipe. Forward a blowing direction of hot air from the tuyere 3 (inside the furnace) is formed a combustion space called as a raceway 5 being also a coke deposit layer, and reduction of iron ore is mainly performed in the combustion space to produce a molten iron.

Figure 2:
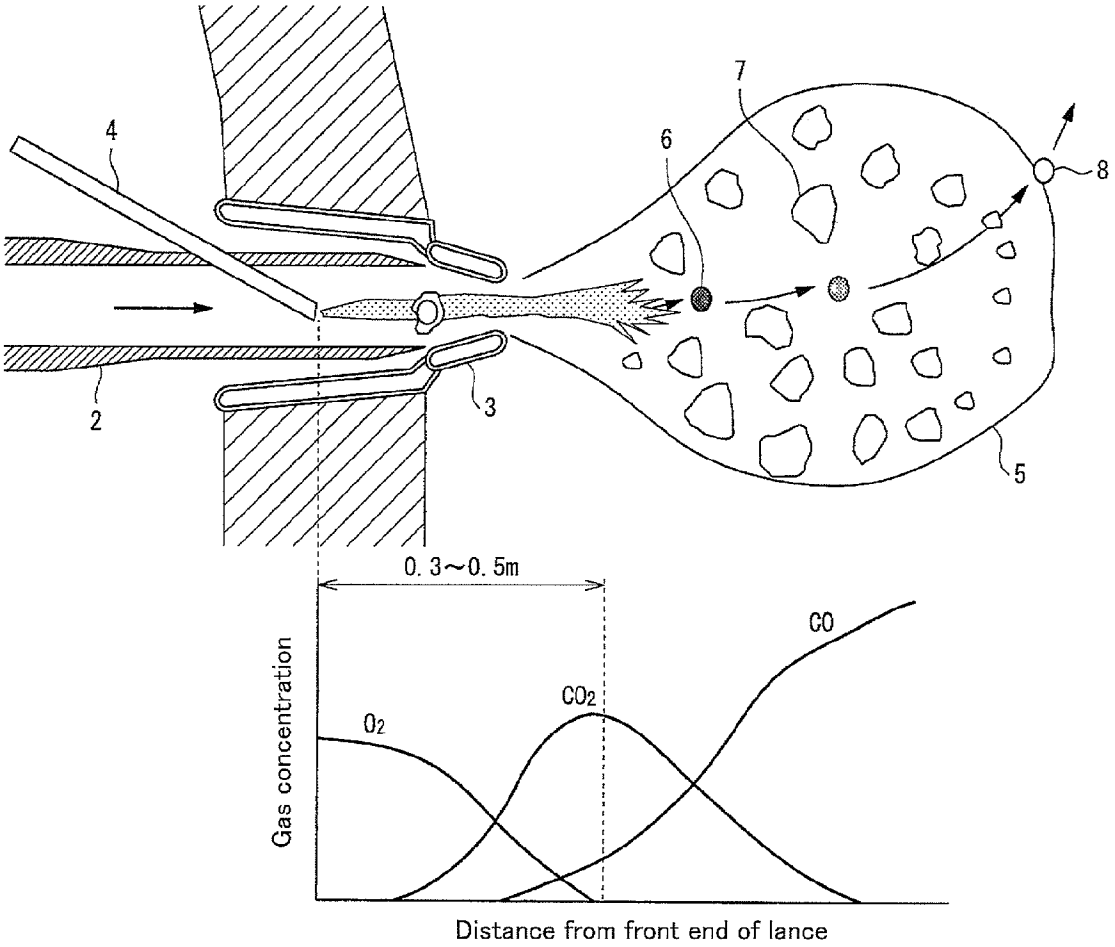
FIG. 2 is a view explaining a combustion state when only pulverized coal is blown through a lance.

FIG. 2 shows a combustion state when only a pulverized coal 6 is blown from the lance 4. The pulverized coal 6 is blown from the lance 4 through the tuyere 3 into the raceway 5 and lumpy coke 7 is charged from the top of the furnace and deposited in the raceway 5, where volatile matter and fixed carbon thereof are combusted. An aggregate of unburned residual carbon and ash, which is generally called as a char, is dispersed from the raceway 5 inside the furnace as an unburned char 8. A blowing rate of hot air forward the blowing direction of hot air blown from the tuyere 3 into the furnace is about 200 m/sec and an $O_2$ existing region from the front end of the lance 4 into the raceway 5 is about 0.3-0.5 m. Therefore, the heating of pulverized coal particles and the contact efficiency (dispersibility) with oxygen ($O_2$) as a combustible gas are necessary to be improved substantially in a level of 1/1000 second.

Figure 3:
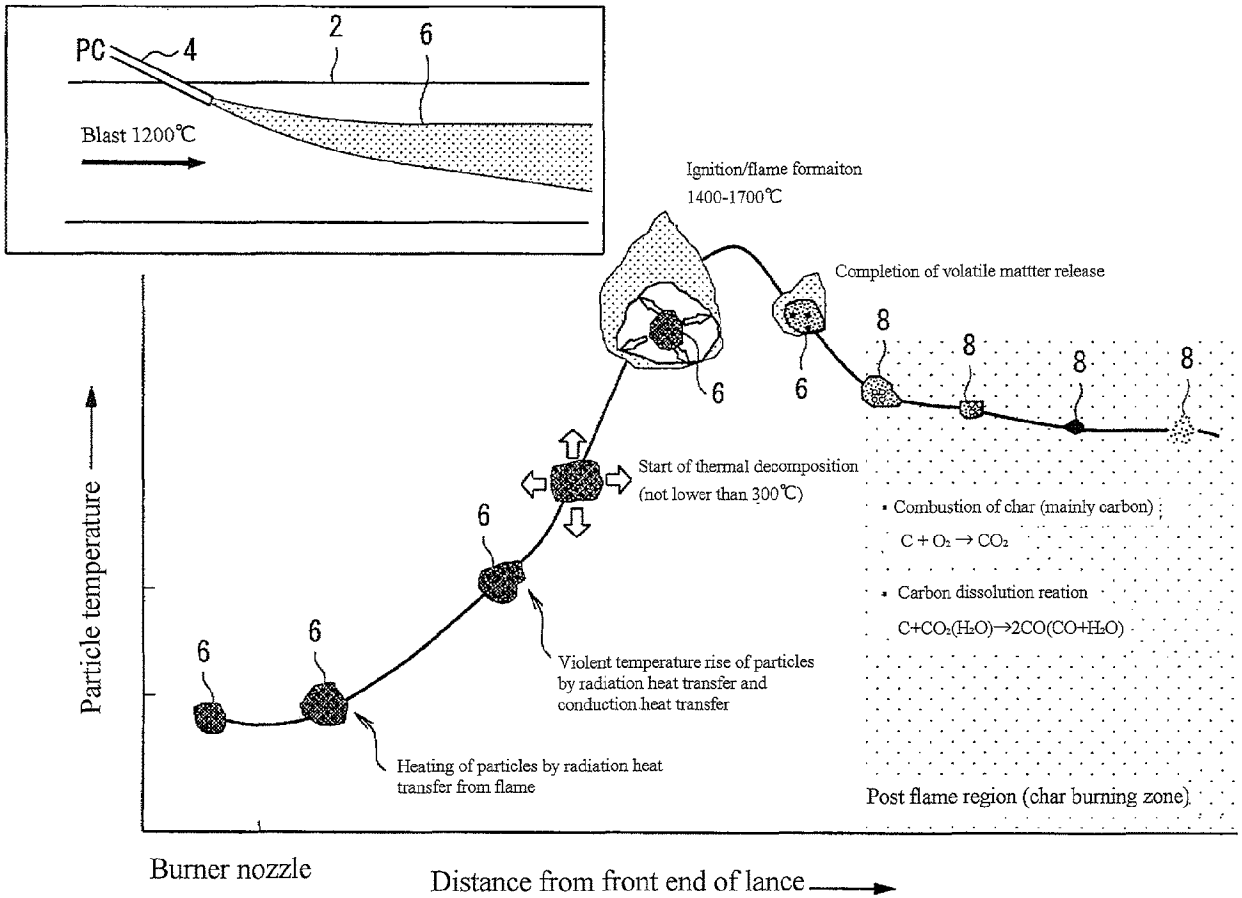
FIG. 3 is a view explaining a combustion mechanism of pulverized coal.

FIG. 3 is an explanatory view of a combustion mechanism when only the pulverized coal (PC) 6 as a solid reducing material is blown from the lance 4 into the blowpipe 2. The particles of the pulverized coal 6 blown from the tuyere 3 into the raceway 5 are heated by radiant heat transfer from the flame in the raceway 5 and further the temperature of the particles is violently raised by radiant heat transfer and conduction transfer. Thermal decomposition is started from a time of heating to not less than 300° C. and volatile matter is ignited to form flame and the combustion temperature (particle temperature) reaches 1400-1700° C. After the volatile matter is discharged, the aforementioned char 8 is formed. Since the char 8 is composed mainly of fixed carbon, carbon dissolving reaction is caused together with the combustion reaction.

Figure 4:
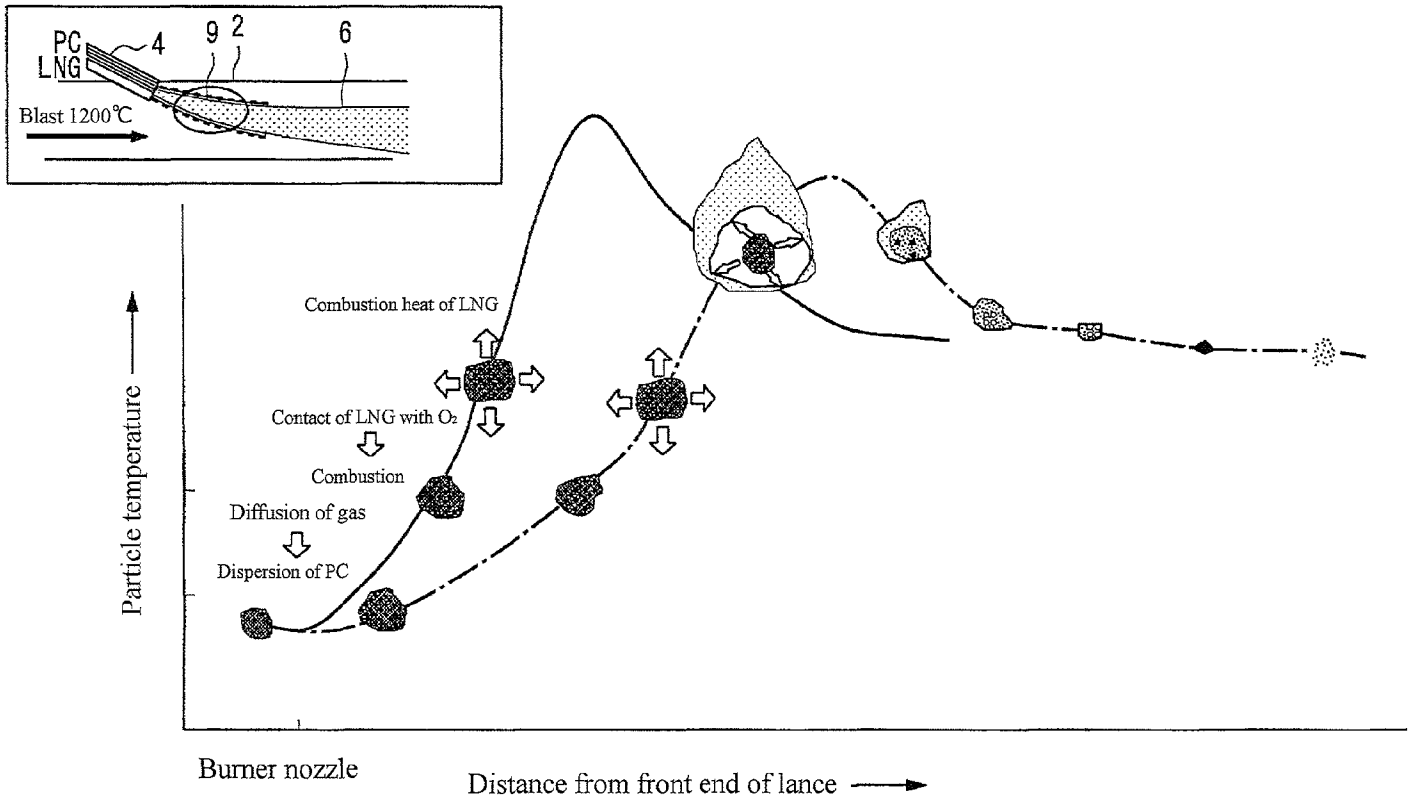
FIG. 4 is a view explaining a combustion mechanism when LNG and oxygen are blown together with pulverized coal.

FIG. 4 is an explanatory view of a combustion mechanism when LNG as a preferable example of the flammable gaseous reducing material and oxygen as a preferable example of the combustible gas (not shown) are blown together with the pulverized coal 6 from the lance 4 into the blowing pipe 2. This figure is a case of simultaneously blowing the pulverized coal, LNG and oxygen simply. Moreover, a dashed line in the figure shows a combustion (particle) temperature in the blowing of only the pulverized coal shown in FIG. 3 as reference. When the pulverized coal and LNG and oxygen are simultaneously blown as mentioned above, it is considered that the pulverized coal is dispersed associated with the diffusion of gas, and LNG is combusted by the contact with oxygen, and the pulverized coal is rapidly heated by the combustion heat. In this case, therefore, the combustion of the pulverized coal is performed in a position near to the lance. As the position of starting the combustion becomes near to the lance, a chance of damaging the lance becomes higher, so that it is necessary to enhance the durability of the lance or a cooling ability.

Figure 5:
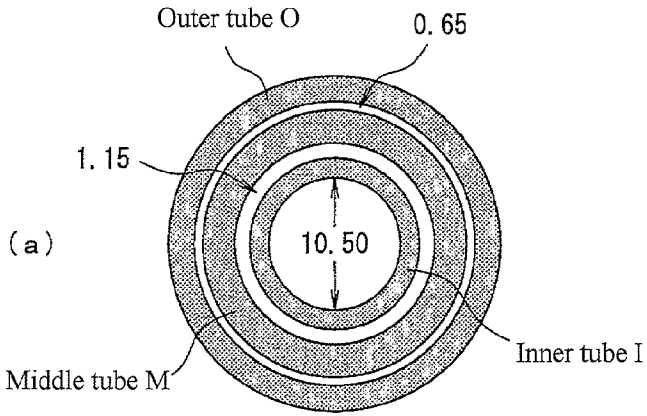
FIG. 5 is an explanatory diagram illustrating an arrangement of blowing tubes in a lance (outer tube).
Figure 5:
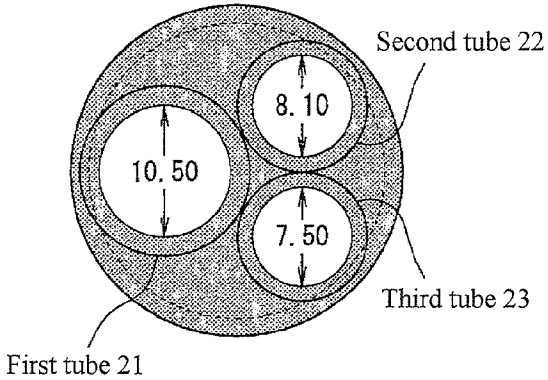

FIG. 5*a* shows a general multiple-tube type lance conventionally used. FIG. 5*b* shows a parallel type lance proposed in an embodiment of the invention. The multiple-tube type lance is a coaxially triple tube of an inner tube I, a middle tube M and an outer tube O made of stainless steel tube, and dimensions of the respective tubes are shown in the figure. Moreover, a gap between the inner tube I and the middle tube M is 1.15 mm, and a gap between the middle tube M and the outer tube O is 0.65 mm.

In the parallel type lance according to an embodiment of the invention, a blowing tube 21 for solid reducing material, a blowing tube 22 for gaseous reducing material and a blowing tube 23 for combustible gas such as oxygen or the like are bundled in parallel and integrally housed in an outer tube for lance, and the dimensions of the respective tubes are shown in the figure.

Figure 6:
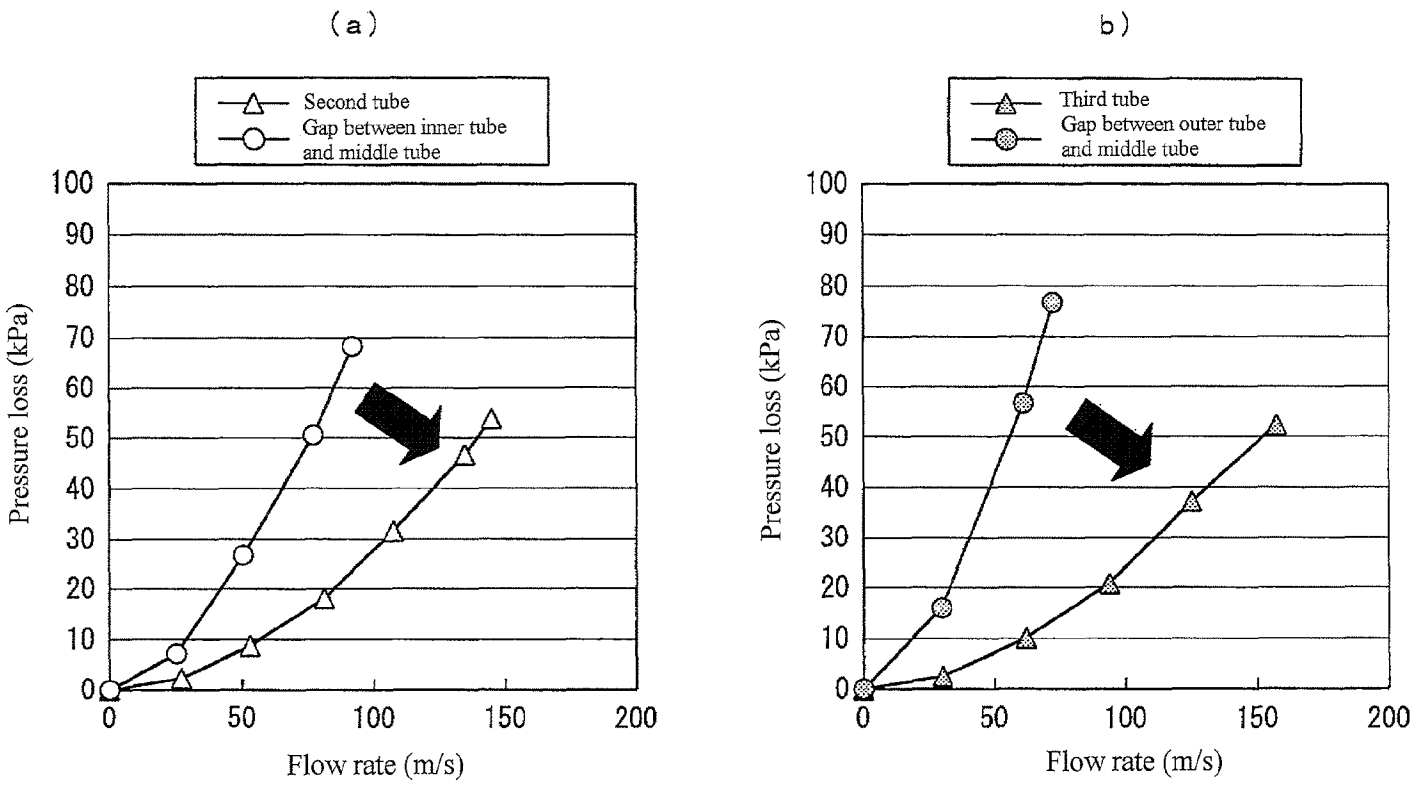
FIG. 6 is a graph showing pressure loss in combustion experiments.

In FIG. 6 are shown results of comparative measurement on pressure loss of the multiple-tube type lance and the parallel type lance. As seen from this figure, the pressure loss is less in the parallel type lance as compared to the multiple-tube type lance under the same pathway. This is considered due to the fact that the blowing space (volume in the blowing tube) is made relatively large to decrease airflow resistance in the case of the parallel type lance.

Figure 7:
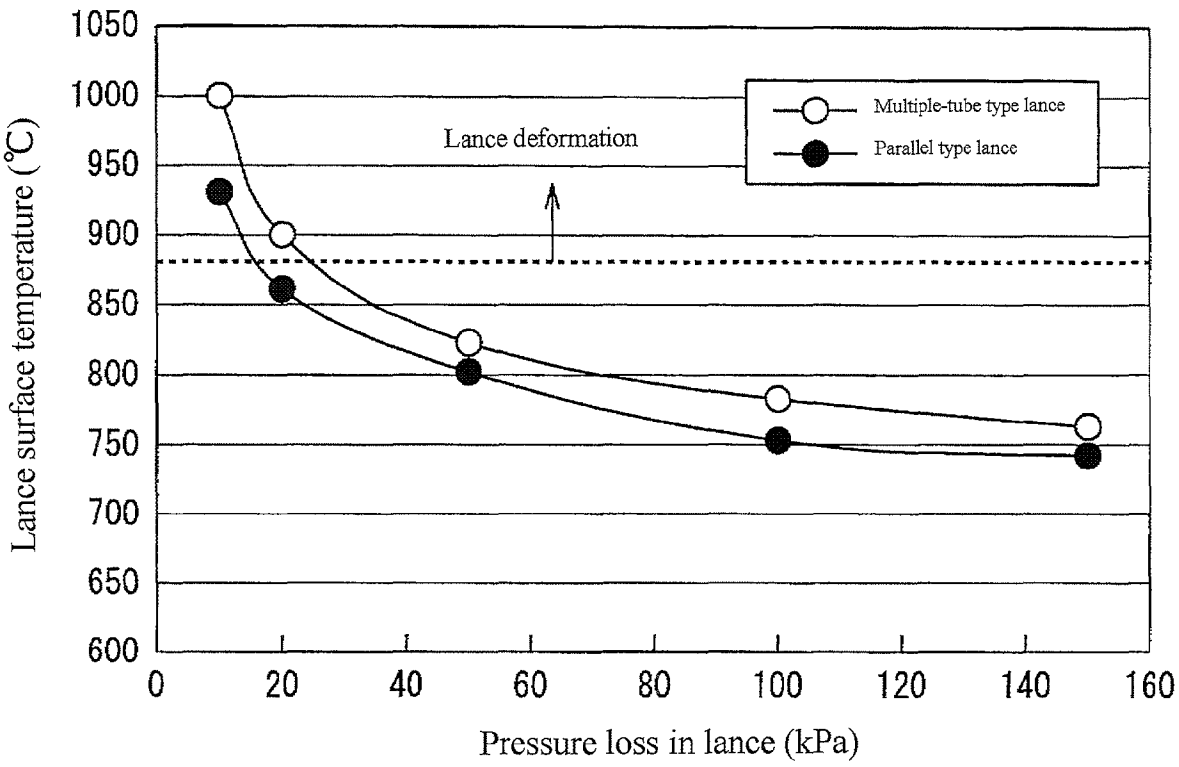
FIG. 7 is a graph showing a lance surface temperature in combustion experiments.

FIG. 7 shows a comparison chart of cooling ability between the lances (multiple-tube type and parallel type). As seen from this figure, the cooling ability under the same pressure loss is higher in the parallel type lance than in the multiple-tube type lance. This is considered due to the fact that the flow rate capable of flowing under the same pressure loss is large because the airflow resistance in the tube is small.

Figure 8:
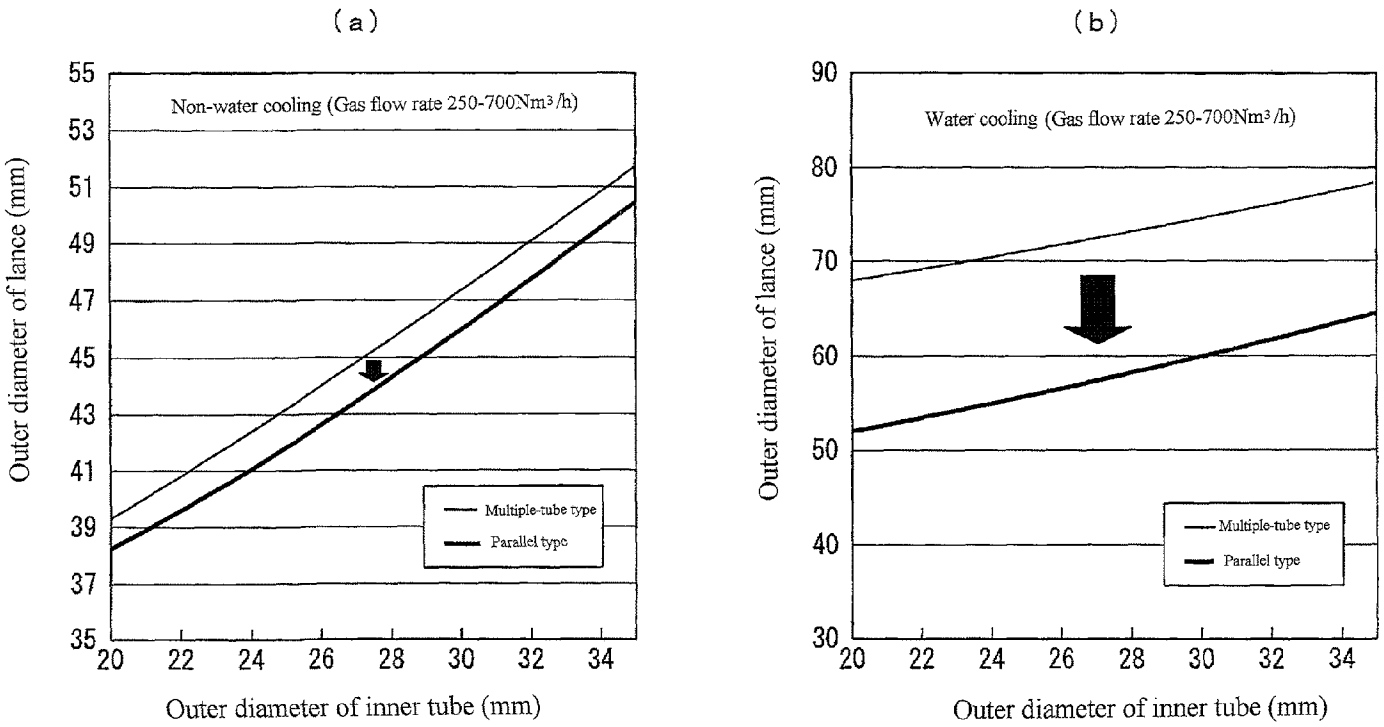
FIG. 8 is an explanatory diagram of an outer diameter in a lance.

In FIG. 8 is noticed an outer diameter of a lance. FIG. 8*a* shows an outer diameter of a non-water cooling type lance, and FIG. 8*b* shows an outer diameter of a water cooling type lance. As seen from this figure, the outer diameter of the lance is small in the parallel type lance as compared to the multiple-tube type lance. This is considered due to the fact that the parallel type lance can decrease the pathway, tube thickness and sectional area of water cooling portion as compared to the multiple-tube type lance.

Figure 9:
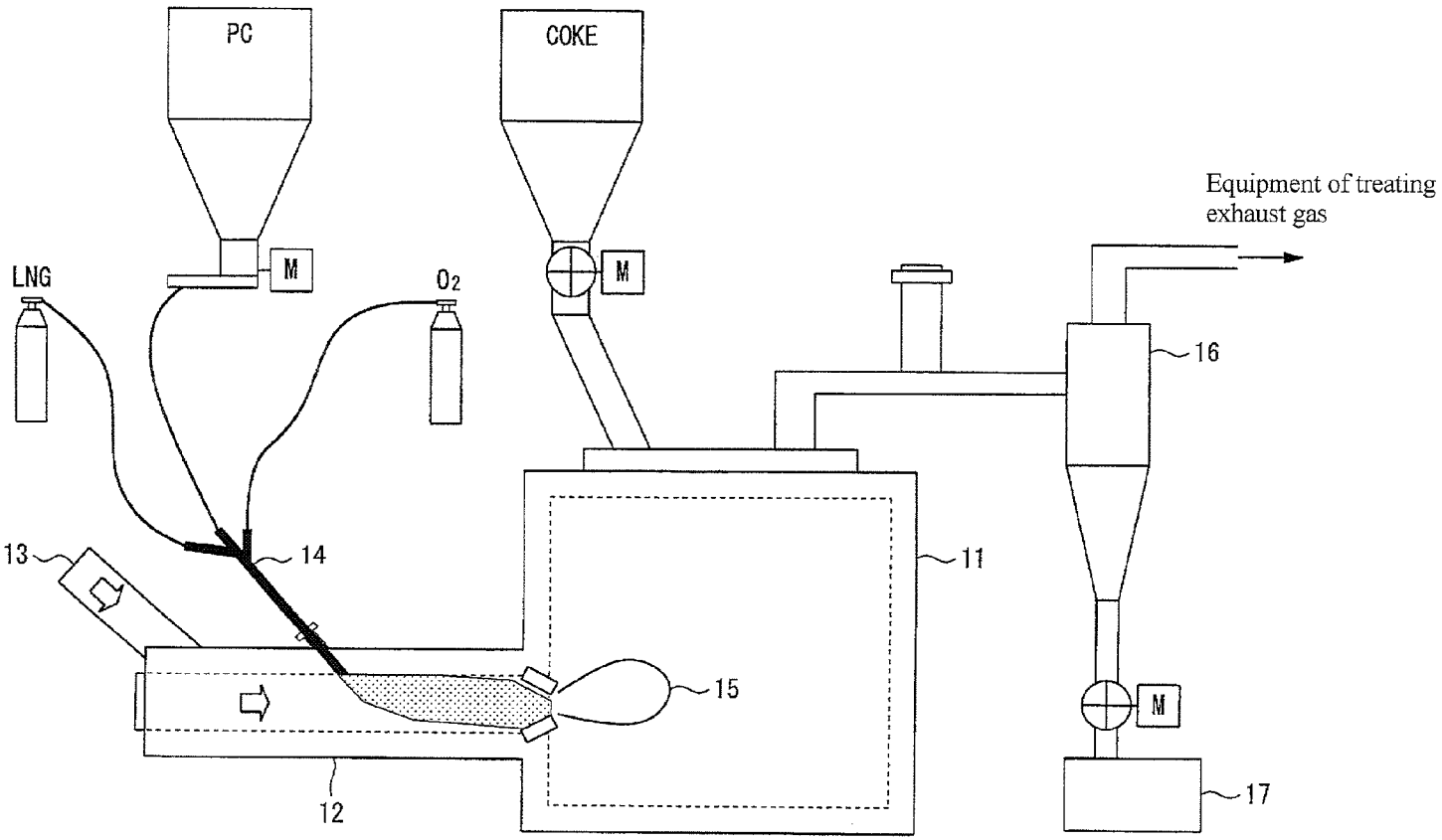
FIG. 9 is a schematic view of an apparatus for combustion experiment.

In order to compare the combustibility between the parallel type lance and the multiple-tube type lance, combustion experiment is performed with an apparatus for combustion experiment shown in FIG. 9. In an experimental furnace 11 are filled lumpy cokes, and an interior of a raceway 15 can be observed through an inspection window. A lance 14 is inserted into a blowpipe (blast pipe) 12, whereby hot air produced by a combustion burner 13 can be blown into the experimental furnace 11 at a given blowing rate. In the blast pipe 12, it is also possible to adjust an oxygen enriched amount during the air blowing. The lance 14 can blow the pulverized coal and either one or both of LNG and oxygen into the blast pipe 12. An exhaust gas produced in the experimental furnace 11 is separated into an exhaust gas and dust by a separating device 16 called as a cyclone, in which the exhaust gas is supplied to an equipment for treating the exhaust gas such as auxiliary combustion furnace or the like, and the dust is collected in a collection box 17.

Combustion Experiment

As a lance 14 are used a single tube lance, a triple tube lance (which is also called as multiple-tube type lance hereinafter) and a parallel type lance prepared by bundling three blowing tubes in parallel and integrally housing them in this combustion experiment. Based on a case that only the pulverized coal is blown through the single tube lance, the pulverized coal is blown through the inner tube and oxygen is blown from a gas between the inner tube and the middle tube and LNG is blown from a gap between the middle tube and the outer tube in the multiple-tube type lance. In the parallel type lance, the pulverized coal, LNG and oxygen are blown through the bundled independent blowing tubes. As to a case that blowing positions are changed around the axis of the lance are measured combustion temperature with a two-color thermometer, pressure loss in the lance, lance surface temperature and outer diameter of a lance. As is well-known, the two-color thermometer is a radiation thermometer for measuring temperature by utilizing heat radiation (movement of electromagnetic wave from high-temperature object to low-temperature object). Noting that wave distribution shifts toward a short wave side as the temperature becomes higher, it is one of wave distribution forms for determining the temperature by measuring the change of temperature in the wave distribution. Especially, radiation energies at two waves are measured for grasping the wave distribution, and the temperature is determined from a ratio thereof.

Figure 10:
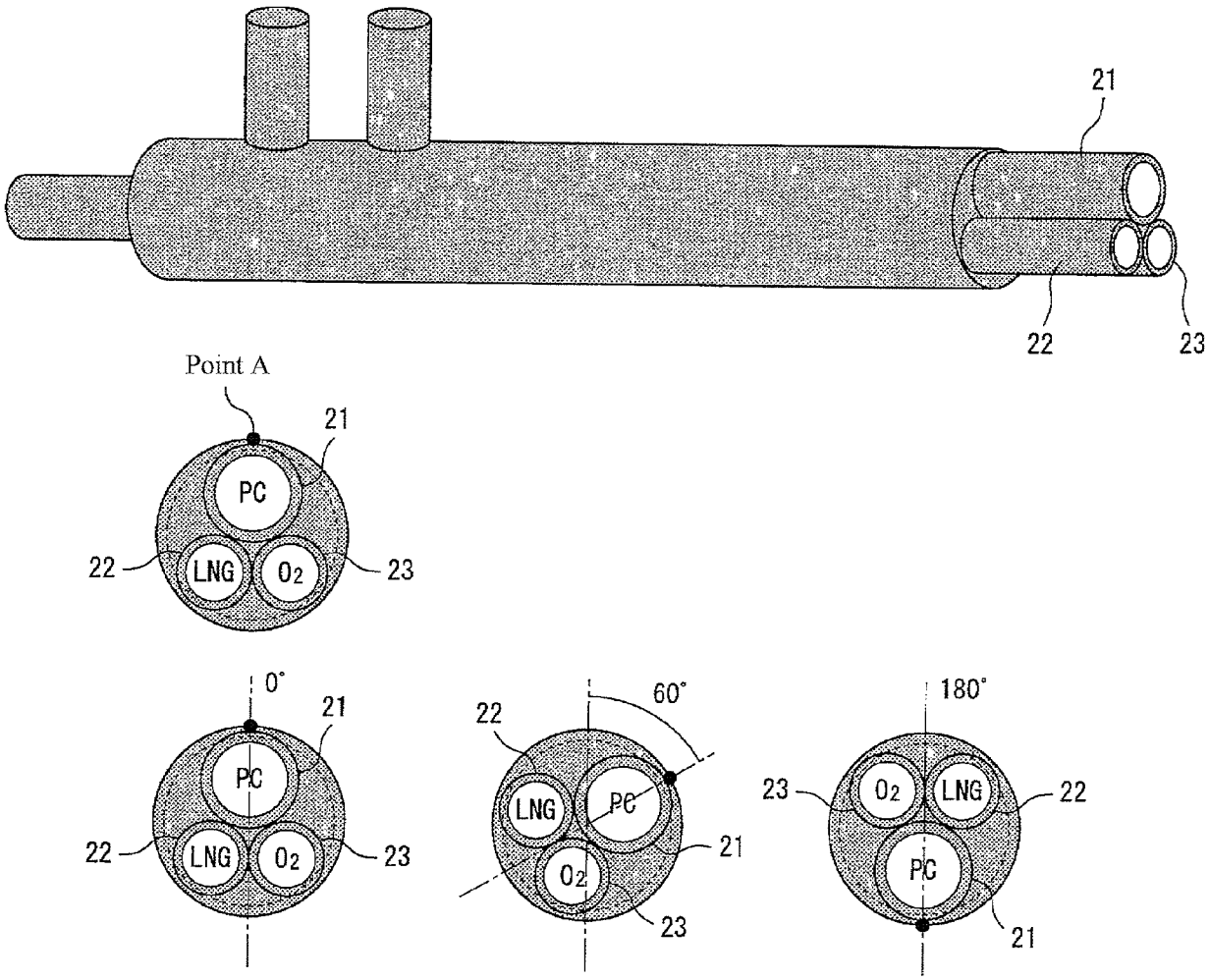
FIG. 10 is a view explaining an arrangement of each blowing tube in a lance.

In this experiment, the pulverized coal (PC) is blown from the blowing tube 21 for solid reducing material and LNG is blown from the blowing tube 22 for gaseous reducing material and oxygen is blown from the blowing tube 23 for combustible gas as shown in FIG. 10. In the case of using a lance prepared by bundling three independent blowing tubes in parallel and integrally housing them into an outer tube for lance, the blowing through the parallel type lance is performed so that the blowing tube for the solid reducing material and the blowing tube for the gaseous reducing material are positioned above the blowing tube for the combustible gas. That is, the position relation of pulverized coal, LNG and oxygen blown into the blowpipe is a relation that oxygen is blown beneath an axial center of the blowpipe and the pulverized coal and LNG are blown above.

Such a position relation means that the blowing through the parallel type lance is performed by such an arrangement of a lance that an an angle of a face passing an outer contact point between a center of the blowing tube for solid reducing material and the lance to a radially vertical plane of the lance inserted into a blowpipe is within ±90° or an arrangement relation of each of the blowing tubes. Namely, when a position corresponding to an outer diameter of the lance on an outer peripheral surface of the blowing tube 21 for pulverized coal is a point A, combustion temperature is measured by the two-color thermometer at a position of 0° that the point A lies in an uppermost part, a position clockwise rotating the point A by 60° around the axial line of the lance and a position rotating the point A by 180°, respectively. Moreover, the insert length of the lance into the blowpipe is 50 mm.

The pulverized coal as a solid reducing material has a fixed carbon (FC) content of 71.3%, a volatile matter (VM) content of 19.6% and an ash content (Ash) of 9.1% and the blowing condition thereof is 50.0 kg/h (corresponding to 158 kg/t as a specific consumption of molten iron). The blowing condition of LNG is 3.6 kg/h (5.0 $Nm^3$/h, corresponding to 11 kg/t as a specific consumption of molten iron). The coke is used to satisfy ${}^{150}{}_{15}D183$ by a test method described in JIS K2151. Blast condition is that a blast temperature of 1100° C., a flow amount of 350 $Nm^3$/h, a flow rate of 80 m/s and $O_2$ enrichment+3.7 (oxygen concentration: 24.7%, enriched to 3.7% with respect to oxygen concentration in air of 21%).

Figure 11:
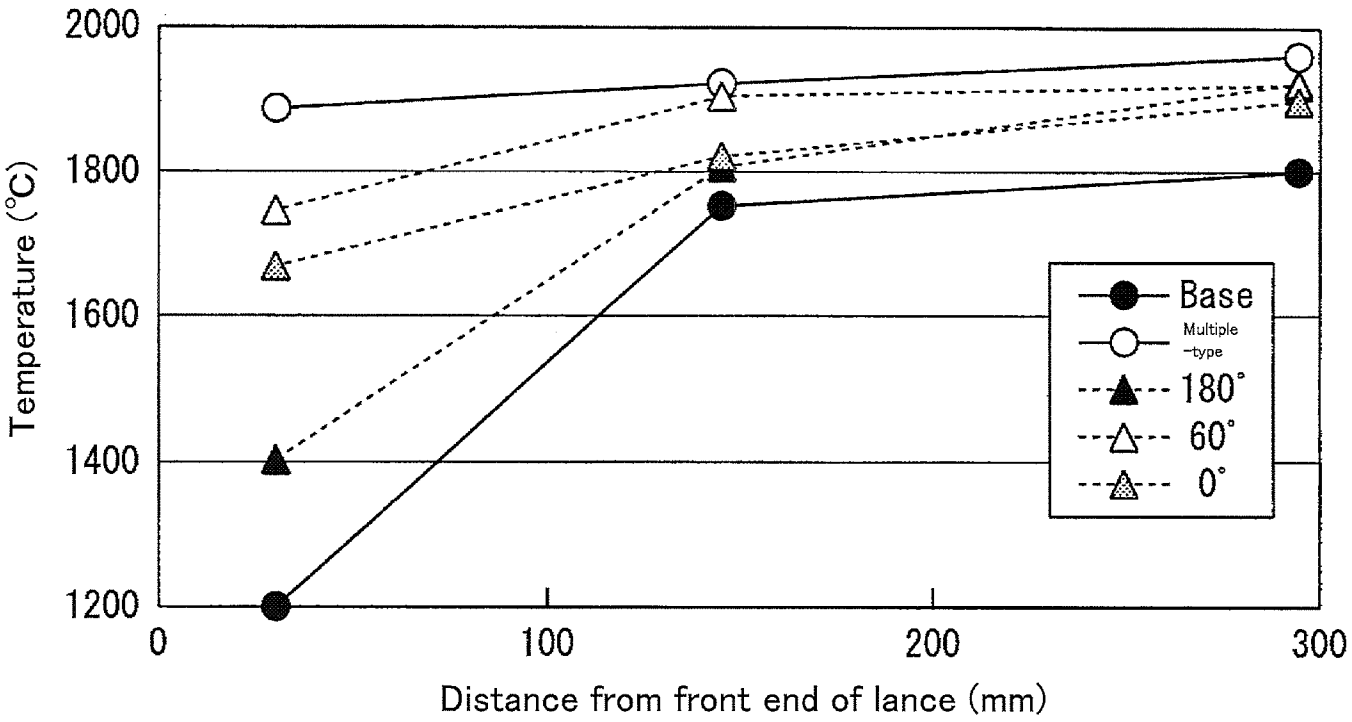
FIG. 11 is a graph showing a change of combustion temperature in combustion experiments.

FIG. 11 shows results of combustion temperature in the combustion experiment. As seen from this figure, when the position of the first tube in the parallel type lance or the pulverized coal blowing tube is changed to 0°, 60° and 180° around the axial line of the lance, the combustion temperature becomes highest at 60° or at a position that the blowing tubes for pulverized coal and LNG are above the oxygen blowing tube. This is considered due to the fact that the combustion field of LNG is made adjacent to the pulverized coal to heat the pulverized coal and oxygen is positioned beneath LNG and pulverized coal to efficiently mix with both LNG and pulverized coal and hence the combustion is promoted.

In the blast furnace operation method adapted to the embodiment of the invention, when the pulverized coal (solid reducing material) 6, LNG (flammable gaseous reducing material) 9 and oxygen (combustible gas) are simultaneously blown through the lance 4 into the tuyere 3, the blowing area of the blowing tube (gap) can be largely maintained without making the outer diameter of the lance extremely large by using the parallel type lance prepared by bundling the respective blowing tubes in parallel and integrally housing them into the outer tube for lance. According to the invention method and lance, therefore, it can be attained to establish the increase of the cooling ability and the improvement of the combustibility, and hence the specific consumption of the reducing material can be decreased.

Although the above embodiment is described by using LNG as a flammable gaseous reducing material, it is possible to use a town gas. In addition to the town gas and LNG, propane gas, hydrogen as well as converter gas, blast furnace gas and coke-oven gas produced in the the iron foundry can be used as the other gaseous reducing material. Moreover, shale gas may be utilized in equivalence to LNG. The shale gas is a natural gas obtained from a shale stratum, which is called as a non-conventional natural gas resource because it is produced in a place different from the conventional gas field.

DESCRIPTION OF REFERENCE SYMBOLS

1: blast furnace, 2: blowpipe, 3: tuyere, 4: lance, 5: raceway, 6: pulverized coal (solid reducing material), 7: coke, 8: char, 9: LNG (flammable gaseous reducing material)

The invention claimed is:

1. A method of operating a blast furnace by blowing a solid reducing material, a gaseous reducing material and a combustible gas into a blast furnace from tuyeres through a lance into a blast furnace, wherein a parallel lance prepared by bundling three independent blowing tubes arranged adjacent to each other and in parallel to each other, and integrally housing the three independent blowing tubes into an outer tube for the lance is used, and either one or both of the gaseous reducing material and the combustible gas are simultaneously blown with the solid reducing material through the respective blowing tubes, wherein the blowing tube for the solid reducing material and the blowing tube for the gaseous reducing material are positioned above the blowing tube for the combustible gas in the blowing through the parallel lance.

2. The method of operating a blast furnace according to claim 1, wherein the blowing tube for solid reducing material, the blowing tube for gaseous reducing material and the blowing tube for combustible gas in the parallel lance are arranged so that an angle of a face passing an outer contact point between a center of the blowing tube for solid reducing material and the outer tube for lance to a radially vertical plane of the lance inserted into a blowpipe is within ±90°.

3. A lance for blowing a solid reducing material, a gaseous reducing material and a combustible gas through tuyeres into a blast furnace in accordance with the method of claim 1, the lance having a structure that three independent blowing tubes are bundled adjacent to each other and in parallel to each other, and the three independent blowing tubes are integrally housed in an outer tube for lance, wherein the blowing tube for the solid reducing material and the blowing tube for the gaseous reducing material are positioned above the blowing tube for the combustible gas.

4. A lance according to claim 3, wherein the blowing tubes are arranged so that an angle of a face passing an outer contact point between a center of the blowing tube for solid reducing material and the outer tube for lance to a radially vertical plane of the lance inserted into a blowpipe is within ±90°.

5. A lance according to claim 3, wherein each of the blowing tubes is a tube having an inner diameter of not less than 6 mm but not more than 30 mm.

6. A lance according to claim 4, wherein each of the blowing tubes is a tube having an inner diameter of not less than 6 mm but not more than 30 mm.

* * * * *